US006341656B1

(12) United States Patent
Fanuel et al.

(10) Patent No.: US 6,341,656 B1
(45) Date of Patent: Jan. 29, 2002

(54) CORE BARREL

(75) Inventors: Philippe Fanuel; Paul Serron, both of Brussels (BE)

(73) Assignee: Dresser Industries, Inc., Carrollton, TX (US)

( * ) Notice: Subject to any disclaimer, the term of this patent is extended or adjusted under 35 U.S.C. 154(b) by 0 days.

(21) Appl. No.: 09/462,186

(22) PCT Filed: Jul. 8, 1998

(86) PCT No.: PCT/BE98/00104

§ 371 Date: Mar. 20, 2000

§ 102(e) Date: Mar. 20, 2000

(87) PCT Pub. No.: WO99/02816

PCT Pub. Date: Jan. 21, 1999

(30) Foreign Application Priority Data

Jul. 8, 1997 (BE) ..... 9700590

(51) Int. Cl.[7] ..... E21B 25/06
(52) U.S. Cl. ..... 175/244; 175/249
(58) Field of Search ..... 175/236, 244, 175/246, 239, 249, 247, 243

(56) References Cited

U.S. PATENT DOCUMENTS 3,854,539 A 12/1974 Sweeney
3,977,482 A * 8/1976 Reed et al. ..... 175/246
4,300,643 A * 11/1981 Lambot ..... 175/244
4,466,497 A * 8/1984 Soinski et al. ..... 175/246
4,552,229 A * 11/1985 Radford et al. ..... 175/240
4,580,643 A * 4/1986 Fox et al. ..... 175/244
5,934,393 A * 8/1999 Marshall ..... 175/236

FOREIGN PATENT DOCUMENTS

| | | |
|---|---|---|
| FR | 1278207 | 4/1962 |
| GB | 486700 | 6/1938 |
| WO | WO 90/05237 | 5/1990 |
| WO | WO 95/21988 | 8/1995 |

* cited by examiner

*Primary Examiner*—Frank S. Tsay
(74) *Attorney, Agent, or Firm*—Browning Bushman P.C.

(57) ABSTRACT

The invention concerns a core barrel, in particular in the field of oil exploration, comprising at least an outer tube (2) and a core bit (3) forming an outer assembly (4) and at least an inner tube (5) forming with a drilling core optionally present therein, and optionally with part of the groups arranged under the drilling core base, an inner assembly (7), suspension and/or guiding means being provided for maintaining the inner assembly (7) inside the outer assembly (4), the suspension and/or guiding means being further arranged such that the inner assembly (7) maintains at least perpendicular to these means (9), with respect to the outer assembly (4), a predetermined axial and/or radial and/or angular freedom of movement greater than usual.

11 Claims, 9 Drawing Sheets

CORE BARREL

BACKGROUND OF THE INVENTION

1. Field of the Invention

The present invention relates to a core barrel, particularly in the field of oil exploration, comprising, on the one hand, at least an outer tube and a coring bit which form an outer assembly and, on the other hand, at least one inner tube which, with a drilled core possibly present therein, and possibly with some of the formations under the base of the drilled core, forms an inner assembly, suspension and/or guidance means being provided to keep the inner assembly inside the outer assembly.

2. Background of the Prior Art

Numerous core barrels of this kind are known. Their suspension and/or guidance means form, between the outer assembly and the inner assembly, mechanical connections of the type involving a bearing, of the radial and step type, and of the double-acting thrust type. It is thus common practice to have at least one upper mechanical connection therein, often of the thrust-bearing type, at the rear end of the inner tube, when considering a direction of advance S of the core barrel into the ground, and to have a lower mechanical connection of the step bearing type (in the bit, for example) at the front end of the inner tube. There may also be intermediate mechanical connections, usually of the step bearing type, particularly when core drilling is to be performed in a position which is steeply inclined with respect to the vertical or even in a horizontal position.

In searching for a core barrel capable of supplying a drilled core sample which is as intact as possible and as representative as possible of the formations being probed, the person skilled in the art tends to make the mechanical connections between the abovedescribed outer and inner assemblies very severe, that is to say to make them have close tolerances, so as to obtain the most efficient possible guidance of the inner tube around the drilled core.

It has, however, been found that the drilled cores obtained could be greatly damaged as the result of the vibrations and jolts transmitted through the string of core-barrel control rods, by the phenomenon known as whirling of the coring bit in its hole, about its axis of rotation, and from the rotation of the latter about the axis of the hole, against the pseudocylindrical interior wall of the hole, which has a diameter greater than that of the bit, and by the catching of the latter in the formation that is to be sampled, etc., that is to say as the result of an unfavourable action of the outer assembly on the inner assembly.

SUMMARY OF THE INVENTION

The inventors of the present invention have resolutely chosen to go against the practice explained hereinabove and consider that the inner tube and the drilled core, which is received therein as core drilling progresses, need to be relieved of the stresses that the abovementioned outer assembly experiences during this same core-drilling operation and transmits to the inner assembly.

To this end, according to the invention, the suspension and/or guidance means are arranged in such a way that the inner assembly retains, at least at the location of these means, with respect to the outer assembly, a predetermined freedom of axial and/or radial and/or angular movement which is greater than usual.

As a result of this, it has thus been found, surprisingly, that harsh stresses on the outer assembly are no longer transmitted, or are transmitted to a very reduced extent, to the drilled core, whose integrity is only better preserved as a result.

It has also become apparent, as a result of this, that the material of the core barrel experiences markedly lower stresses and is better preserved than was the case in the past as regards destruction by impact, by the forcing of parts onto one another, and onto the drilled core.

According to one embodiment of the invention, the suspension and/or guidance means comprise at least one rotary thrust bearing for suspending and/or supporting the inner tube in the outer tube, this thrust bearing being mounted therein with a radial and/or axial and/or angular clearance that is greater than the usual clearance.

According to a particular embodiment of the invention, the suspension and/or guidance means comprise hydrostatic bearing means in which pressurized core-drilling fluid forms, during core drilling, one or more elastic cushions for the radial and/or axial and/or angular location.

According to an advantageous embodiment of the core barrel of the invention, means are arranged therein so as, during core drilling, and in collaboration with the effects of the pressure of the core-drilling fluid on the inner assembly, to keep the latter hydrostatically suspended within the outer assembly within the limits of the said freedom of movement and/or of the aforementioned clearance.

Other details and particular features of the invention will emerge from the secondary claims and from the description of the drawings which are appended to this text and which illustrate, by way of nonlimiting examples, some advantageous embodiments of the invention, which are depicted diagrammatically in axial section unless otherwise indicated, with cutaway, and possibly to different scales.

DETAILED DESCRIPTION OF THE ILLUSTRATED EMBODIMENTS

In the various figures, the same reference notation is used to denote elements which are identical or similar.

Figure 1:
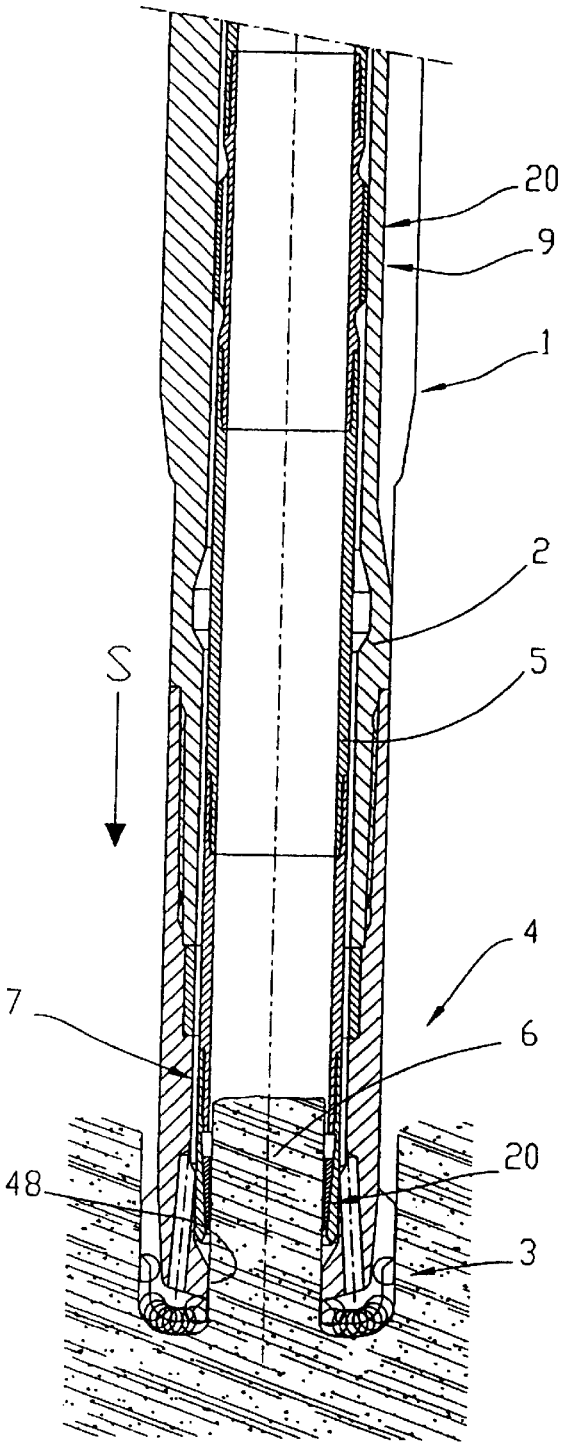
FIG. 1 shows a front end of a core barrel in which the present invention can be implemented.
Figure 2:
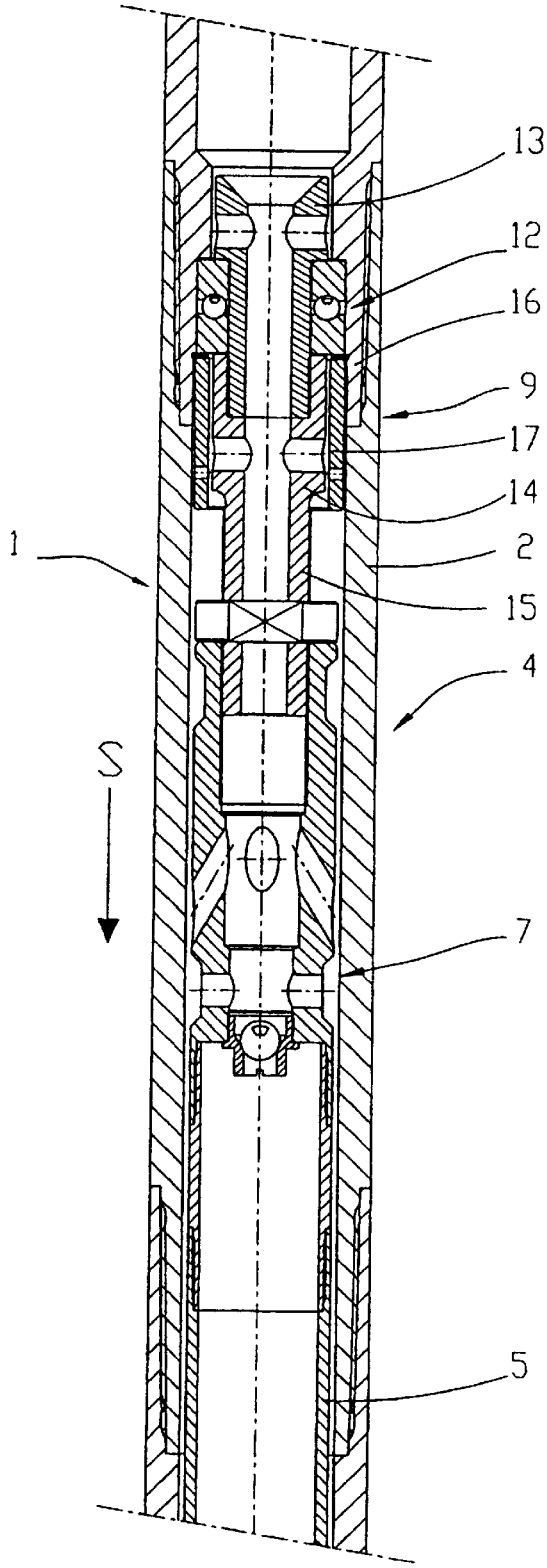
FIG. 2 shows the core barrel of FIG. 1 at the location of the rear end of the inner tube and its suspension in the outer tube.

The core barrel 1 (FIGS. 1 and 2) of the invention comprises, on the one hand, an outer tube 2 and a coring bit 3 which may be considered as forming an outer assembly 4 and, on the other hand, at least one inner tube 5 which may be considered as forming, with a drilled core 6 possibly present therein, an inner assembly 7. It may also be considered that at least some of the formations arranged under the base of the drilled core 6 form part of the inner assembly 7. Means 9 for suspending and/or guiding the inner assembly 7, essentially the inner tube 5, in the outer assembly 4, are provided.

According to the invention, the suspension and/or guidance means 9 are arranged in such a way that the inner assembly 7 retains, at least at the location of these means, with respect to the outer assembly 4, a predetermined freedom of movement which is greater than usual, whether this be axially and/or radially and/or angularly with respect to the longitudinal axis of the outer assembly 4.

This predetermined freedom, or this less severe connection than usual between the outer assembly 4 and inner assembly 7, prevents harsh movements, of a defined amplitude, of the outer assembly 4 from being communicated with the inner tube 5 and from the latter to the drilled core 6 which would thus be damaged by these harsh movements and/or would each time be broken off, at its base, from those of the formations located under this base. A drilled core 6 thus broken exhibits artificial discontinuities by comparison with the formation being drilled, and does not therefore show its true nature. A drilled core 6 thus broken and/or damaged also carries a considerable risk, which is directly associated with the number of discontinuities produced, of jamming in the inner tube 5, by comparison with a continuous, if possible one-piece, drilled core 6.

In one embodiment of the invention, the suspension and/or guidance means 9 comprise (FIG. 3) at least one rotary thrust bearing 12, for example ball bearing, for suspending and/or supporting the inner tube 5 in the outer tube 2. According to the invention, this thrust bearing 12 is mounted with a radial and/or axial and/or angular clearance that is greater than the clearance usually selected in the art. To achieve this, the thrust bearing 12 is held, with a chosen axial clearance, -on the side of its inside diameter, between two elements 13 and 14 screwed home, for example, one inside the other and supporting the actual inner tube 5 (not depicted) on a male thread 15, and -on the side of its outside diameter, between two clamping elements 16 and 17 of the outer tube 4 which are also screwed one into the other and which secure a thrust ring 18 (of the circlip type).

In order to be screwed one into the other, it is merely a matter of choice and/or of construction constraints as to whether it is the element 13 which for this purpose will have a male thread (FIG. 3) and the element 14 which will have a female thread, or vice versa.

Figure 3:
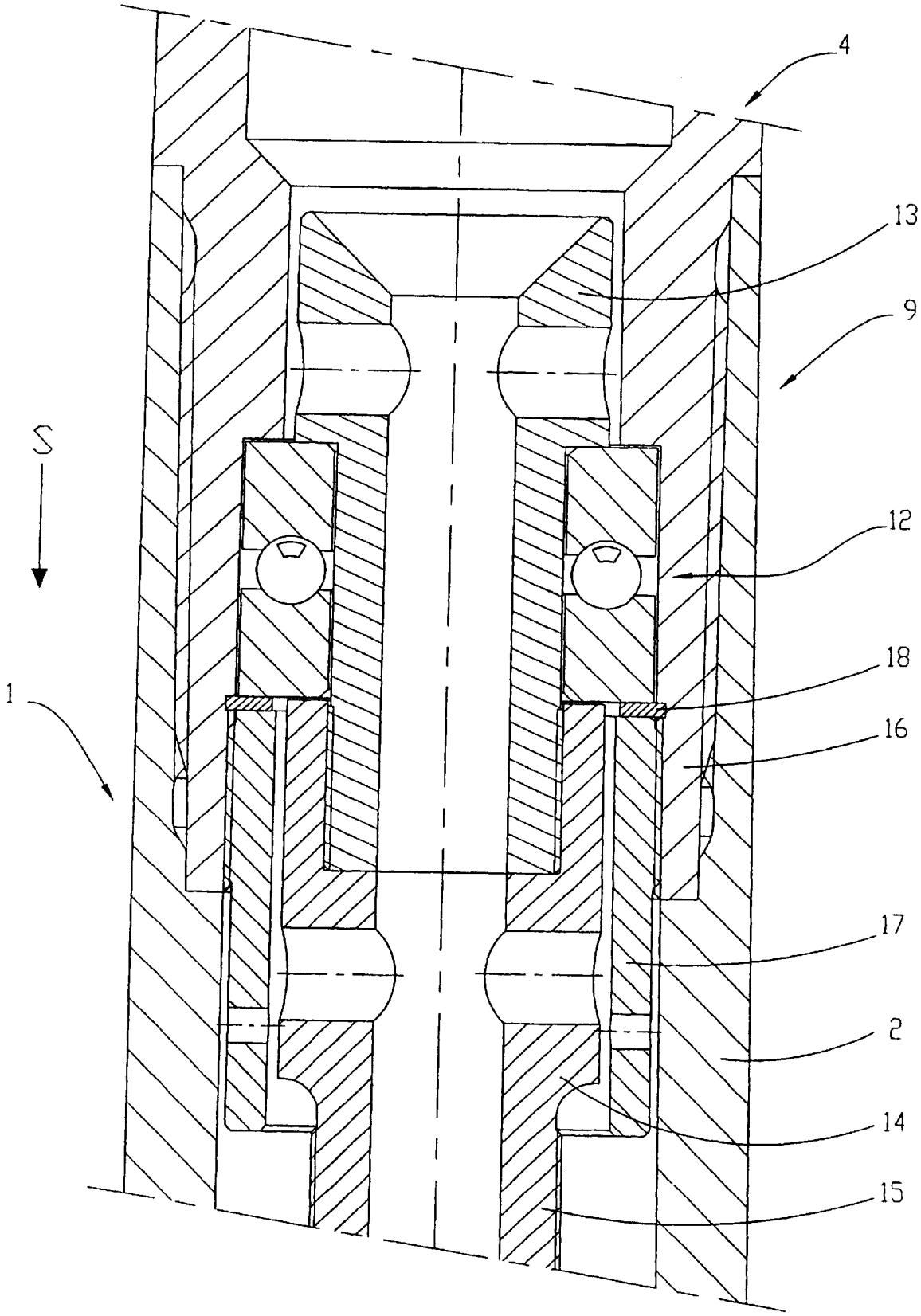
FIG. 3 shows the location of the said suspension of the inner tube in the outer tube, on a larger scale.

As FIG. 3 shows, a radial clearance may also be provided between the said rotary thrust bearing 12 and, on the one hand, the elements 13 and 14 and, on the other hand, the clamping elements 16 and 17.

The combination of the axial and radial clearances described in respect of FIG. 3 gives this assembly an angular clearance between the axis of the inner tube 5 and that of the outer tube 2.

In another embodiment, separately from or in addition to the foregoing, the suspension and/or guidance means 9 comprise at least one bearing 20 (FIGS. 1 and 4) and/or 21 (FIG. 5) for radially supporting the inner tube 5 in the outer assembly 4, this bearing 20, 21 being arranged in such a way as to allow a radical clearance (FIGS. 1 and 4) and/or an axial clearance (FIGS. 4 and 5) and/or an angular clearance (by combining the radial and axial clearances greater than the clearances usually set) between the outer tube 2 and inner tube 5.

Figure 5:
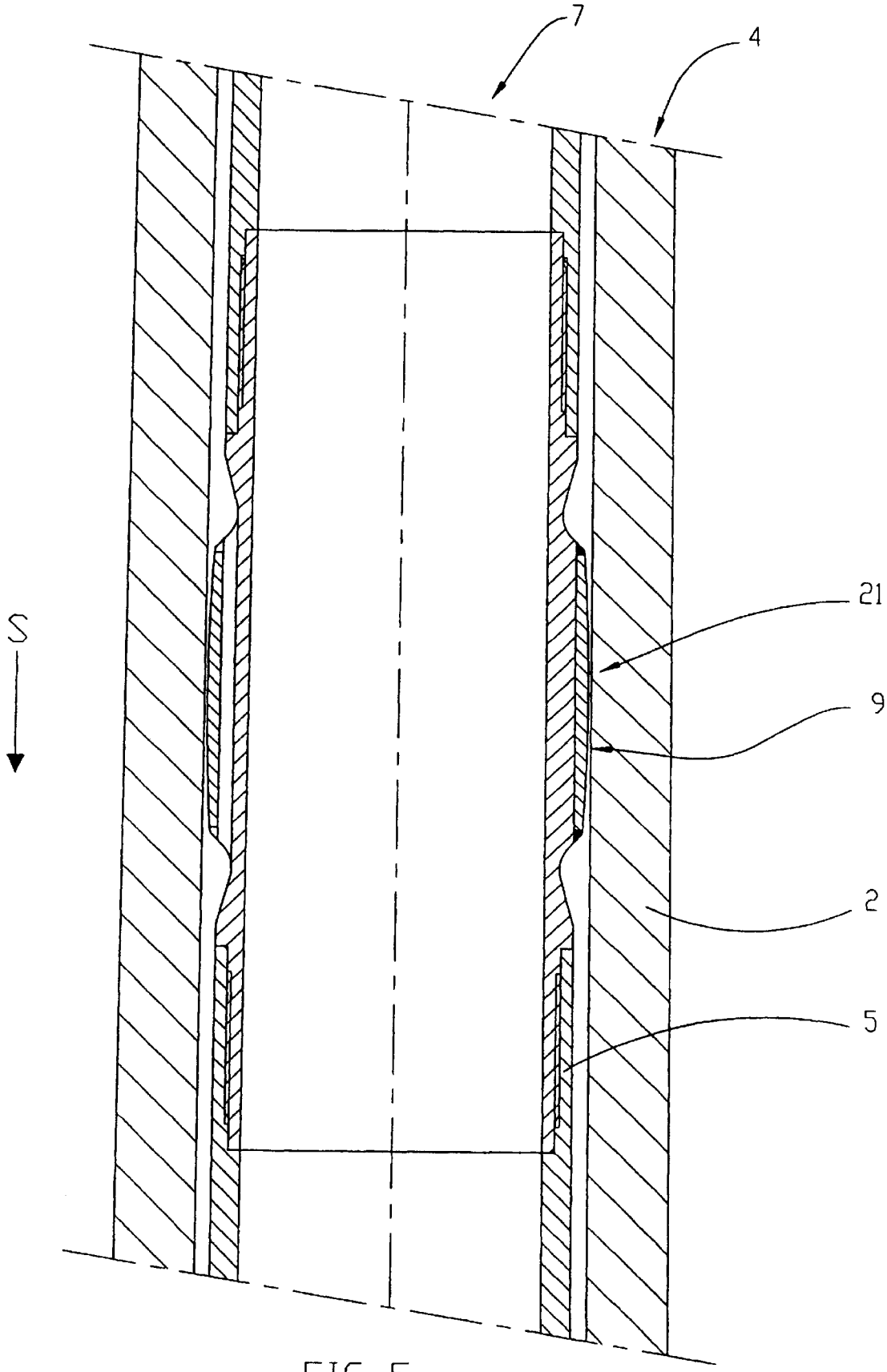
FIG. 5 shows one embodiment of an intermediate guide means implementing the present invention.

In FIG. 5, the bearing 21 exhibits, for the part of the inner tube 5 which constitutes the shaft thereof, a barrel shape so as to increase the angular clearance it is possible to have between the axes of the inner tube 5 and outer tube 2, and therefore flexibility of the mechanical connection at this point.

Figure 6:
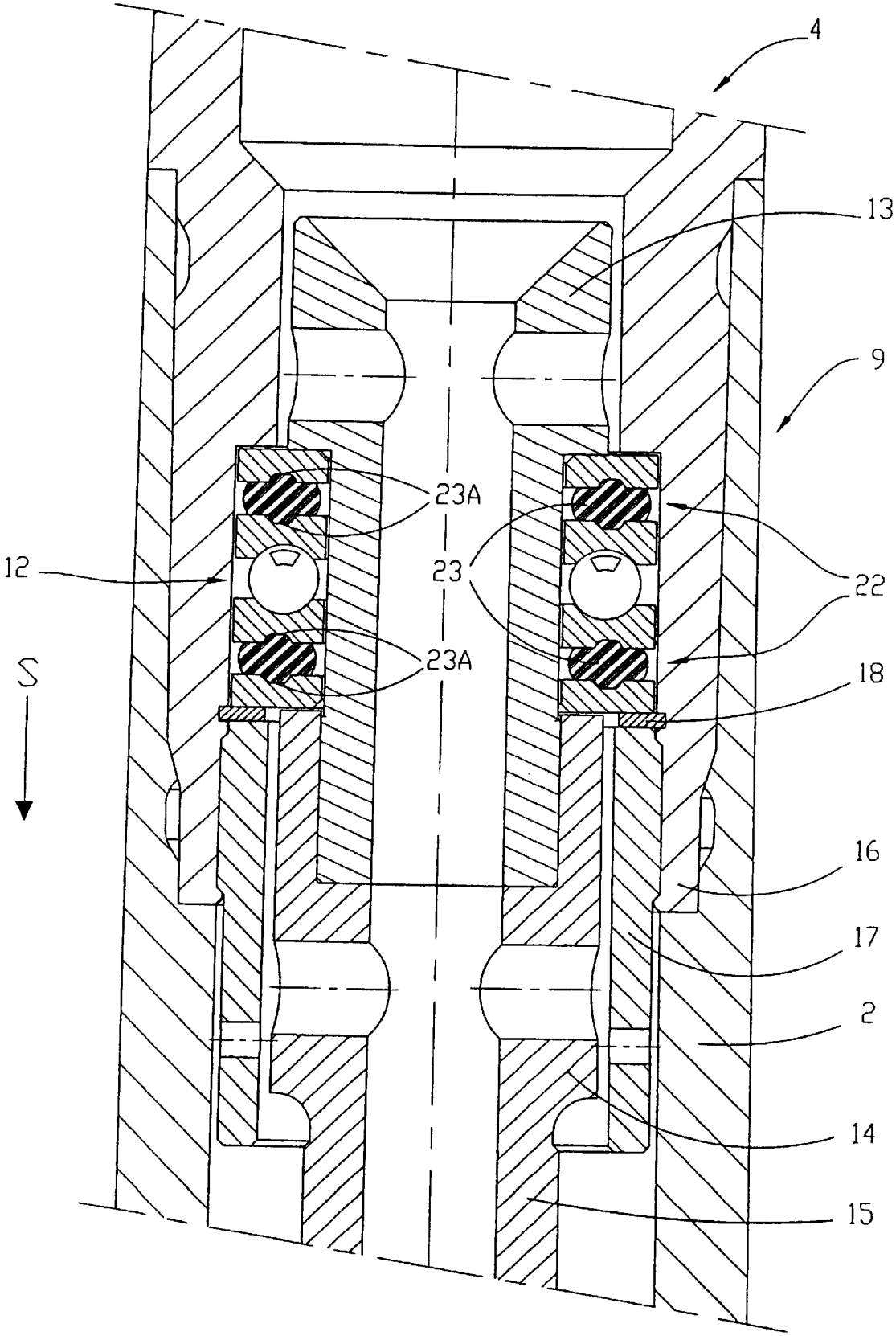
FIG. 6 shows another embodiment of the suspension of the inner tube in the outer tube.

According to one particular embodiment of the invention, the suspension and/or guidance means 9 may comprise (FIG. 6) elastic means 22. These elastic means 22, which are also intended to make the mechanical connection between the outer assembly 4 and inner assembly 7 more flexible and to deaden the transmission of jolts, may comprise rubber or synthetic rings 23 arranged, for example, above and below the rotary thrust bearing 12 mounted, moreover, like the one in FIG. 3. These rings 23 may have annular beads 23A intended to collaborate with grooves in the surrounding parts with a view to providing the constituent elements thus stacked with a suitable location with respect to each other.

Figure 8:
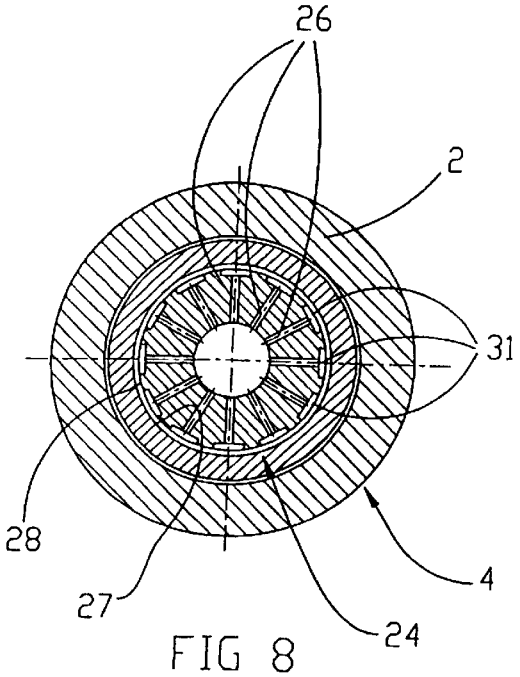
FIG. 8 shows a cross section on the plane VII—VII of FIG. 7.

Advantageously, the suspension and/or guidance means 9 may comprise (FIG. 7) hydrostatic bearing means 24 in which pressurized core-drilling fluid, arriving from the surface through a central duct 25 and leaving via radial ducts 26 forms, during core drilling, between a cylindrical or conical interior wall 27 of the outer assembly 4 and, opposite it, a cylindrical or conical exterior wall 28 of the inner assembly 7, one or more elastic cushions for providing this inner assembly 7 with radial and/or angular location with respect to the outer assembly 4. The fit and the distribution of the flow of core-drilling fluid between the radial ducts 26 and the usual connecting ducts 29 leading the fluid from the central duct 25 into the gap between the outer tube 2 and inner tube 5 makes it possible to obtain a pressure difference causing centrifugal radial flow from the radial ducts 26, for example into oblong chambers 21, one dimension (the longitudinal dimension) of which is visible in FIG. 7, and the other dimension of which is visible in FIG. 8. Each oblong chamber 31 may thus generate a fluid cushion between the walls 27 and 28.

Figure 9:
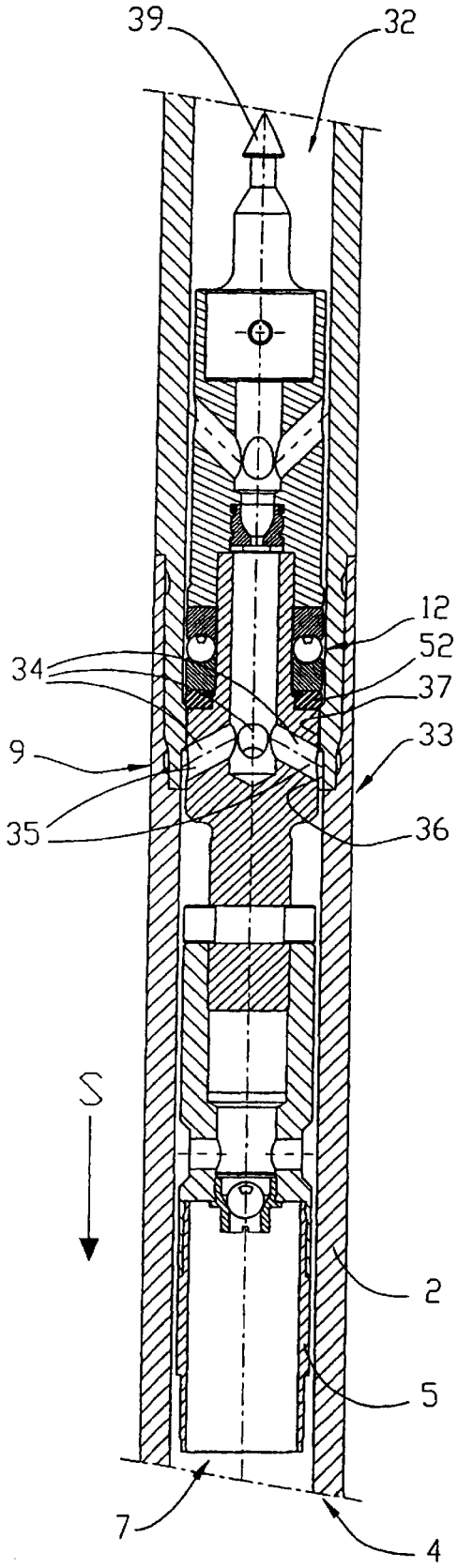
FIG. 9 shows, at the location of the rear end of the inner tube and of the suspension thereof in the outer tube, a core barrel of the so-called wireline type, the front end of which may be similar to the one depicted in FIG. 1.

FIG. 9 shows one instance of a core barrel 1 of the wireline type, in which the inner tube 5 is suspended in the outer assembly 4 under the effect of its own weight and the pressure of the core-drilling fluid arriving at 32 from the surface of the ground. In particular, in this type of core barrel, means 33 may be arranged so as, during core drilling, and in collaboration with the effects of the pressure of the core-drilling fluid pushing the inner tube 5 downwards and with the friction of the drilled core 6 entering this inner tube 5, to keep the latter hydrostatically suspended within the outer assembly 4 within the limits of the said freedom of movement and/or of the aforementioned clearance.

To this end, the means 33 may comprise, for example, a collection of bristles, or some other coating (not depicted) arranged on the interior wall of the inner tube 5, to offer known resistance to the entry of the drilled core 6 into this tube 5.

As an alternative, the means 33 may comprise means for regulating the escape of a fluid contained in the inner tube 5, these means being designed so that by controlled escape they thus offer known resistance to the entry of the drilled core 6 into the tube 5.

The means 33 may comprise a combination of passages 34 for the core-drilling fluid, the outlet orifices 35 of which passages open onto a peripheral surface of the inner assembly 7, and of interior surfaces 36 and 37 of the outer assembly 4, which have different diameters.

Figure 11:
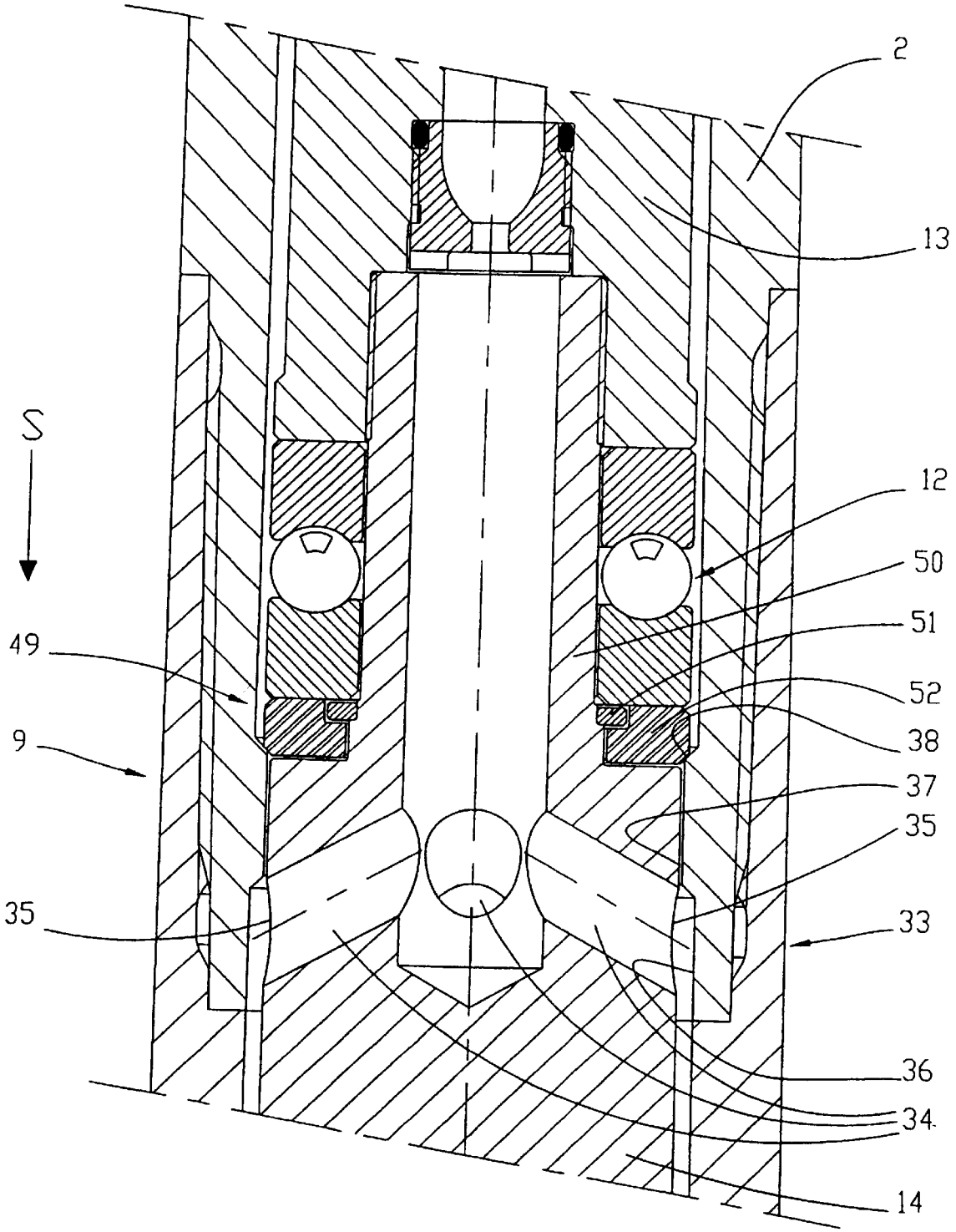
FIG. 11 shows, on a larger scale, the location of the aforementioned suspension of FIG. 10, the inner tube occupying a position supported in the outer tube.

At rest, the fluid outlet orifices 35 occupy a position, depicted in FIGS. 9 and 11, in which they face an interior surface 36 which is some distance away, so as to allow the core-drilling fluid to leave them without being throttled.

Through the action of the said known resistance, the inner tube 5 will tend to be pushed back by the drilled core 6 in the opposite direction to the direction of advance S for core drilling, so as no longer to rest against a suspension shoulder 38 (FIGS. 9 and 11) of the outer assembly 4. Thus, the orifices 35 occupy a position depicted in FIG. 12, in which they gradually come to face another interior surface 37 which is less distance from the orifices 35, so as gradually to throttle the outlet of core-drilling fluid and thus increase its pressure upstream of the orifices 35 as the innner assembly 7 rises up inside the outer assembly 4. The increase in pressure will tend to push the inner assembly 7 back in the direction of advance S of core drilling, and a state of equilibrium will thus be sought, away from the shoulder 38, between opposing thrusts due to the said known resistance and to the increase in fluid pressure which results from its gradually being throttled.

Figure 12:
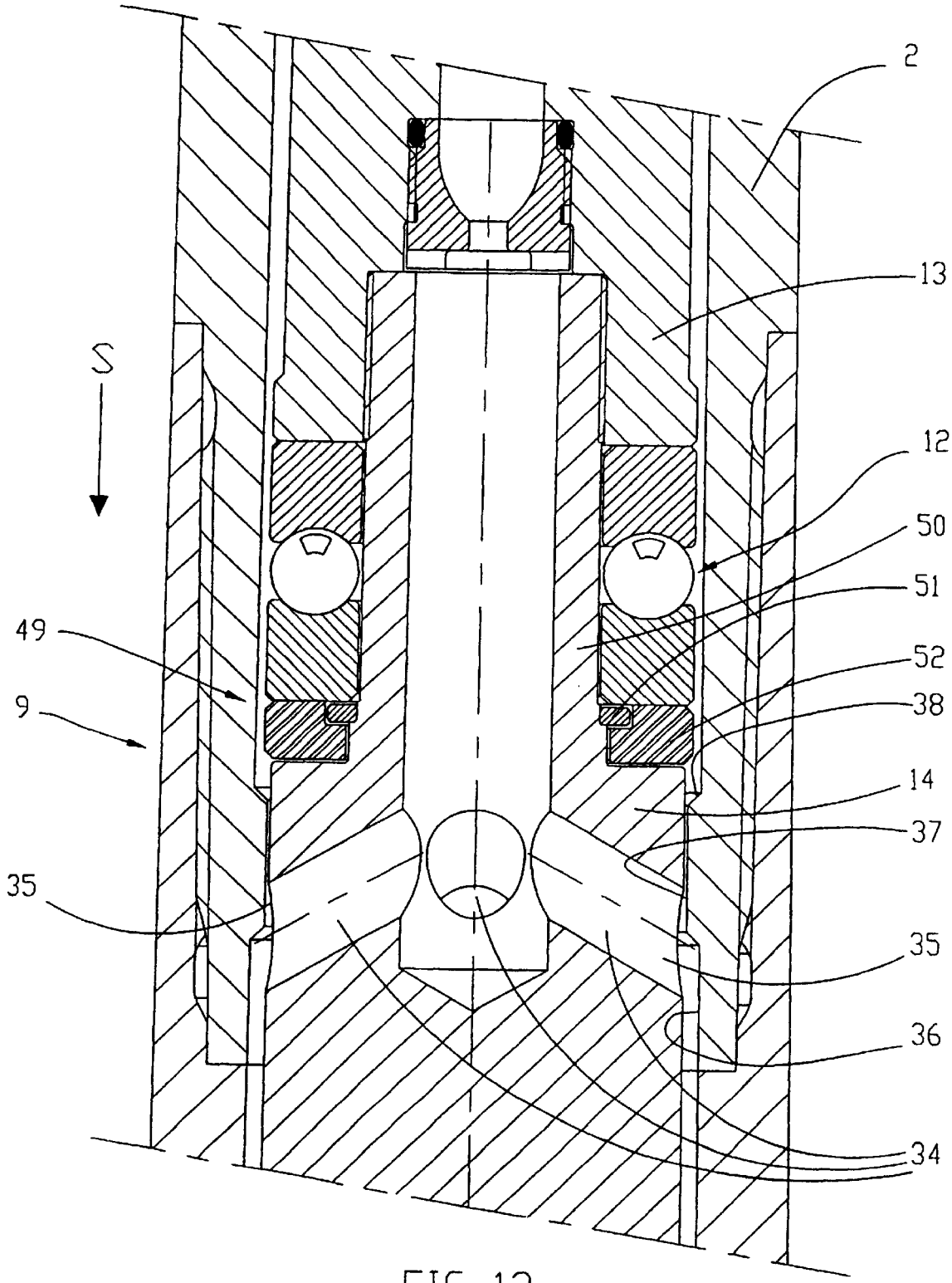
FIG. 12 shows, on the same scale as FIG. 11, the same suspension location, the inner tube occupying a position in which it is said to be hydrostatically suspended in the outer tube.

When the inner assembly 7 leaves the shoulder 38, there is in fact a leak of fluid at this point (FIG. 12). The "hydrostatic" equilibrium obtained for hydrostatic suspension therefore results from the self weight of the inner tube 7 and of its suspension means, from the said known resistance, from the flow rate of core-drilling fluid and leaks thereof, including through the orifices 35. Any change which occurs in the pressure of the fluid is visible at the surface to the operator of the core barrel 1, who can therefore take appropriate action in order, for example, having deduced that the drilled core 6 has jammed in the inner tube 5, to alter this pressure and attempt thereby to unjam the drilled core 6.

In FIG. 9, the inner assembly 7 comprises, at the rear end of its suspension and/or guide means 9, a means 39, known per se in the art of wirelines, for grasping the inner tube 5 in order to at least withdraw it (with a drilled core 6) from the outer tube 2.

Figure 10:
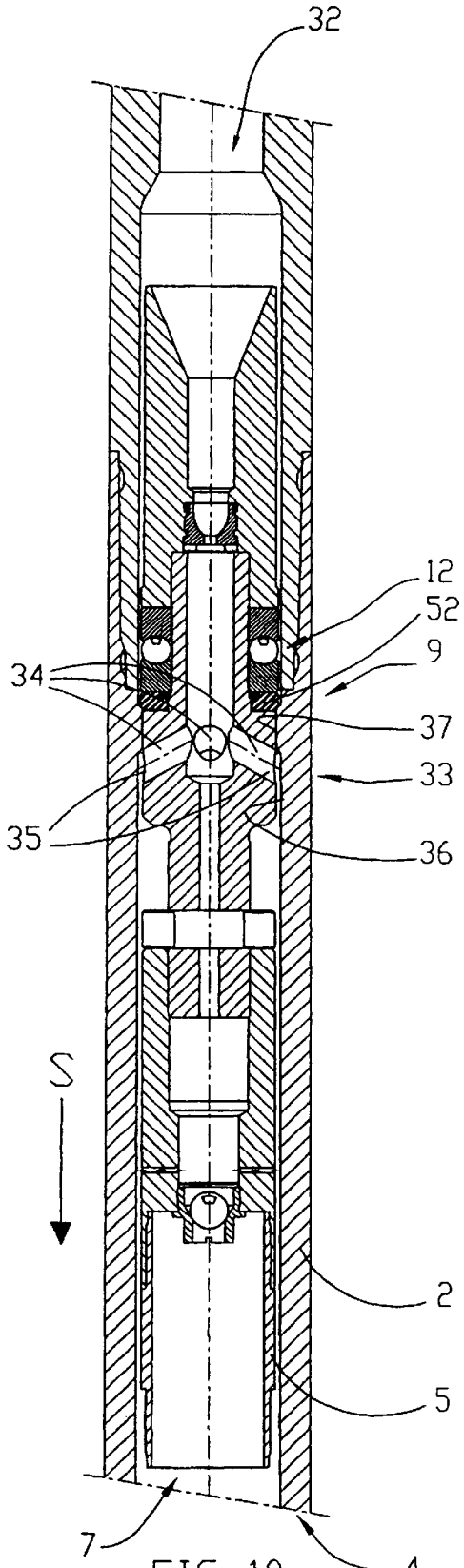
FIG. 10 shows, in a view similar to that of FIG. 9, one embodiment of a core barrel, the inner tube of which cannot be withdrawn from the outer tube using the wireline technique.

In FIG. 10, the inner assembly 7 is similar to the one in FIG. 9, except that it has no means 39 for grasping because, for example on account of a restricted inside diameter of the outer tube 4 upstream of the inner assembly 7 (when considering the direction of flow of core-drilling fluid through the core barrel), the inner assembly 7 cannot be raised using the said wireline technique. As a result of that, the configuration of the ducts for the passage of core-drilling fluid from the point 32 and directed towards the front end of the core barrel 1 may differ from that of FIG. 9 and, for example, have the shape of a funnel. The pressure of this fluid at the point 32 is converted into a force which thrusts the inner tube 5 in the direction S towards the said front end of the core barrel 1, in the core-drilling position, to the exclusion of any mechanical means.

Figure 7:
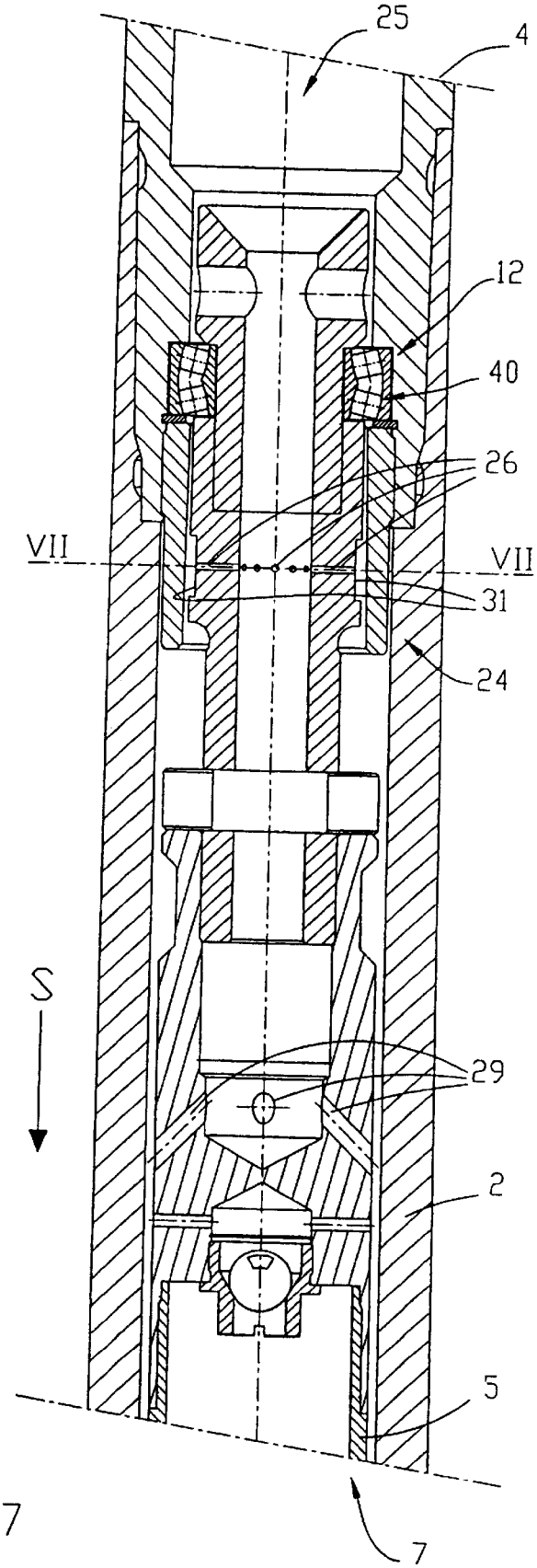
FIG. 7 shows another alternative form of the means for suspending and/or guiding the inner tube in the outer tube.

FIG. 7 shows, by way of an alternative form, that the suspension and/or guidance means 9 may comprise a spherical thrust bearing 40 to increase the flexibility of the mechanical connections between the outer assembly 4 and the inner assembly 7.

It must be understood that the invention is not in any way restricted to the embodiments described and that many modifications may be made thereto without departing from the scope of the present invention.

Figure 4:
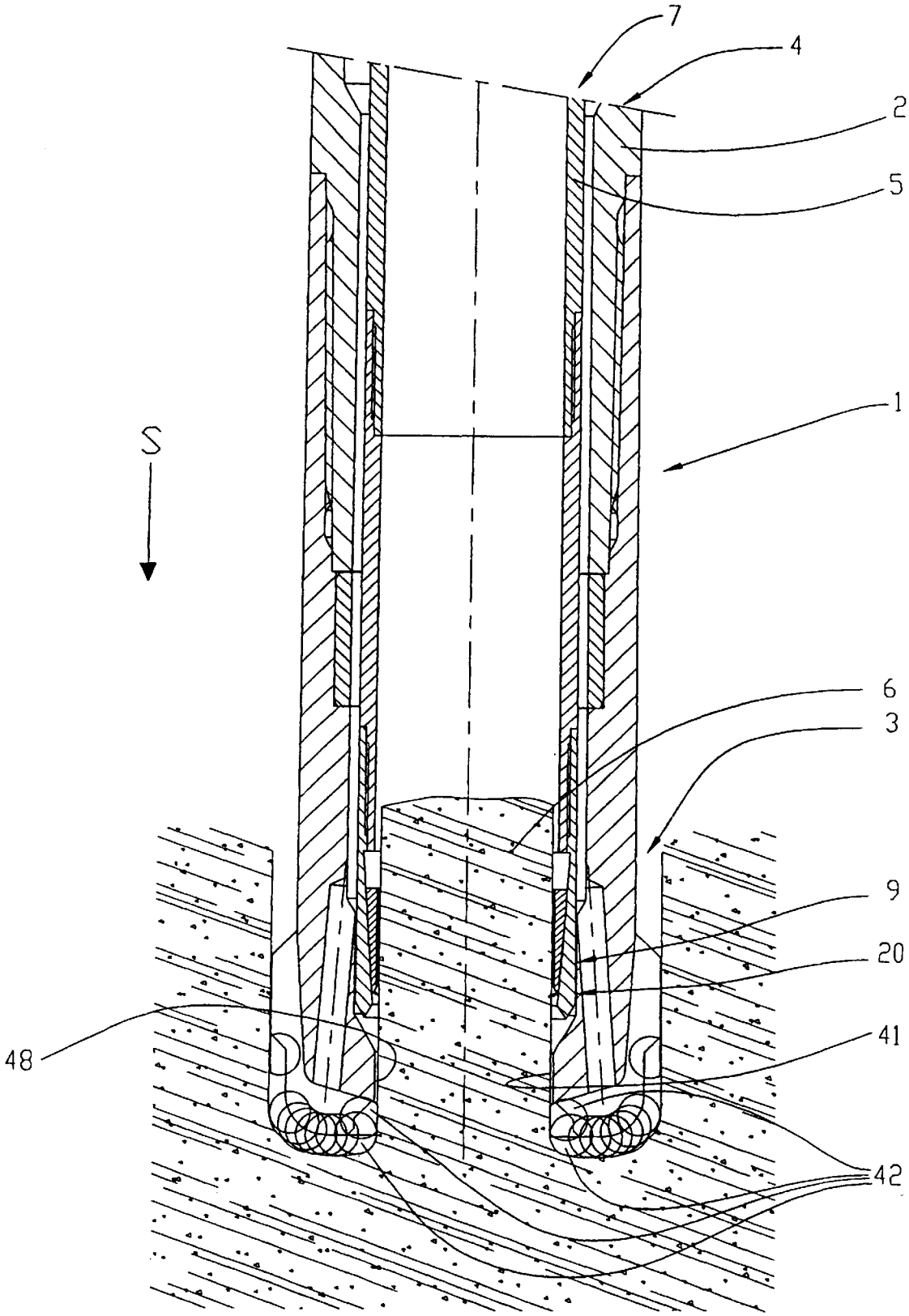
FIG. 4 shows the front ends of the inner and outer tubes and the coring bit, on a larger scale.

Thus, FIG. 4 shows that the bit 3 advantageously has an internal passage 41, the diameter of which is greater than the diameter exhibited by one or more cutters 42 closest to its axis of rotation and intended to determine the outside diameter of the drilled core 6. The purpose of this is to provide clearance at this point, so as to reduce the enclosure of the drilled core 6 in the bit 3 and thus not subject this drilled core 6 to unfavourable reactions of the bit 3 during work. This extent of enclosure may also be reduced by reducing the axial length of what is known as the internal clearance 48 (FIGS. 1 and 4) of the bit 3 (that is to say the passage provided therein for the drilled core 6) as far as possible.

This falls within the scope of the objectives of the invention, namely the search for an optimum minimum number of elements and/or points of mechanical connection or of contact between what has been defined hereinabove as being the outer assembly 4 and the inner assembly 7. Likewise, and for the same purpose, the geometric dimensions of the suspension and/or guidance means 8 are preferably optimized particularly to increase the clearances between the outer assembly 4 and inner assembly 7, to reduce the diameters and/or lengths (for example to reduce or avoid enclosures) by comparison with what, hitherto, had tended to be common practice for the person skilled in the art.

A labyrinth seal 49, arranged on part of the body 50 of the suspension means 9, below the rotary thrust ball bearing 12 (or, as appropriate, spherical thrust bearing) may be noticed, particularly in FIGS. 11 and 12. The labyrinth seal 49 may for example consist of an annular seal 51, mounted tightly on the body part 50, and a bearing ring 52 which, for example, collaborates with the suspension shoulder 38 as is described hereinabove and which has an annular groove in which the annular seal 51 may be housed with annular clearances.

When the bearing ring 52 is resting against the suspension shoulder 38, core-drilling fluid passing between the outer tube 2 (FIG. 11) and the screwed element 13 is practically prevented from passing to the support point but will tend to pass through the thrust ball bearing 12 and the assembly clearances between the latter and the body part 50 and between the latter and the bearing ring 52. This may markedly restrict the flow rate of fluid along the mentioned path, according to the annular gaps organized between these parts.

In one embodiment, not described, an intermediate tube located between the outer tube 2 and the inner tube 5 and approximately coaxial therewith may, as the case may be, form part of the outer assembly 4 or of the inner assembly 7.

Key to Figures

S direction of advance of core drilling
1 core barrel
2 outer tube
3 coring bit
4 outer assembly
5 inner tube
6 drilled core
7 inner assembly
9 suspension and/or guidance means
12 rotary thrust bearing

13 screwed element of 7, 5
14 screwed element of 7, 5
15 male thread of 14
16clamping element of 4, 2
17 clamping element of 4, 2
18 thrust ring
20 bearing of 9
21 bearing of 9
22 elastic means of 9
23 ring of 22
23A annular bead of 23
24 hydrostatic bearing of 9
25 central duct of 1
26 radial ducts of 24
27 cylindrical or conical interior wall of 4, 2
28 cylindrical or conical exterior wall of 7, 5
29 connecting ducts of 7, 5
31 oblong chambers of 24
32 point at which pressurized core-drilling fluid arrives
33 hydrostatic suspension means of 5, 7
34 core-drilling fluid passages of 23
35 orifices of 34
36 interior surface of 4, 2
37 interior surface of 4, 2
38 suspension shoulder
39 means of grasping of 5, 7
40 spherical thrust bearing
41 internal passage of 3
42 cutters of 3
48 internal clearance of 3
49 labyrinth seal
50 body part of 9, 14 (FIG. 11)
51 annular seal on 50
52 bearing ring of 7, 5

What is claimed is:

1. A core barrel, particularly in the field of oil exploration, comprising:

an axially extending outer tube and a coring bit having a common central axis which together form an outer assembly;

an axially extending inner tube having a central axis, said inner tube being received within said outer assembly and being adapted to receive a core formed by the drilling movement of said outer assembly; and a supporting arrangement mounting said inner tube for relative axial, radial and angular movement of said inner tube central axis within said outer assembly to at least partially isolate drilling movements of said outer assembly from said inner tube whereby a core received in said inner tube is protected from damage induced by said drilling movements.

2. A core barrel according to a claim 1, characterized in that the supporting arrangement comprises at least one rotary thrust bearing mounted with physical clearance between said inner tube and said outer assembly to provide relative movement between said inner tube and said outer assembly.

3. A core barrel as defined in claim 1 wherein said supporting arrangement comprises at least one bearing connecting said outer assembly and said inner tube to permit radial and axial and combined axial and radial movement between the central axis of said outer assembly and the central axis of said inner tube.

4. A core barrel as defined in claim 1, characterized in that said supporting arrangement comprises elastic material.

5. A core barrel as defined in claim 1, characterized in that said supporting arrangement comprises a hydrostatic bearing in which pressurized core-drilling fluid forms one or more elastic cushions permitting relative motion between said inner tube and said outer assembly.

6. A core barrel as defined in claim 1, characterized in that said supporting arrangement comprises at least one spherical thrust bearing.

7. A core barrel as defined in claim 1, characterized in that said supporting arrangement is activated by the effects of the pressure of core-drilling fluid acting on said inner assembly to keep said inner assembly hydrostatically suspended within said outer assembly.

8. A core barrel as defined in claim 7, characterized in that said supporting arrangement is activated by the effects of pressure of the core-drilling fluid on the interior wall of said inner tube to resist the entry of a drilled core to said inner tube.

9. A core barrel as defined in claim 7, characterized in that said supporting arrangement regulates the escape of a drilling fluid contained in said inner tube to resist entry of a drilled core into said inner tube.

10. A core barrel as defined in claim 1, characterized in that said coring bit has an internal passage of a diameter greater than the internal bit passage defined by cutters on said bit closest to the axis of rotation of said bit and intended to determine the outside diameter of the drilled core and wherein the axial length of said bit passage is maintained at a limited length within the body of said coring bit.

11. A core barrel as defined in claim 2, characterized in that said supporting arrangement comprises a labyrinth seal for restricting flow of core-drilling fluid passing through said rotary trust bearing.

* * * * *